US012168860B2

(12) United States Patent
Reynolds et al.

(10) Patent No.: US 12,168,860 B2
(45) Date of Patent: Dec. 17, 2024

(54) PNEUMATIC LIFT AND RECHARGE SYSTEM FOR HORIZONTAL WATER WELLS

(71) Applicant: Core Management, LLC, Lipan, TX (US)

(72) Inventors: Jarrod Nicholas Reynolds, Lipan, TX (US); Edward Frank Gelsone, Spring Branch, TX (US); Wade Cosgrove, Weatherford, TX (US)

(73) Assignee: Core Management, LLC, Lipan, TX (US)

( * ) Notice: Subject to any disclaimer, the term of this patent is extended or adjusted under 35 U.S.C. 154(b) by 0 days.

(21) Appl. No.: 18/222,406

(22) Filed: Jul. 14, 2023

(65) Prior Publication Data

US 2024/0018757 A1 Jan. 18, 2024

Related U.S. Application Data

(60) Provisional application No. 63/389,199, filed on Jul. 14, 2022.

(51) Int. Cl.
*E03B 5/06* (2006.01)
*E21B 47/047* (2012.01)

(52) U.S. Cl.
CPC ..... *E03B 5/06* (2013.01); *E21B 47/047* (2020.05)

(58) Field of Classification Search
CPC ... E03B 5/06; E03B 5/04; E03B 5/045; E21B 47/047
See application file for complete search history.

(56) References Cited

U.S. PATENT DOCUMENTS 542,622 A * 7/1895 Bacon ..... E21B 43/123 417/109
566,102 A * 8/1896 Titus ..... E03B 5/04 417/111
855,518 A * 6/1907 Lockett ..... E21B 43/123 417/115
5,059,064 A * 10/1991 Justice ..... E02F 5/10 239/20
5,147,530 A 9/1992 Chandler et al.
5,373,897 A 12/1994 Skarvan
5,827,010 A 10/1998 Hassett
6,312,605 B1 11/2001 Kerfoot
6,382,933 B1 5/2002 Anderson
6,745,815 B1 6/2004 Senyard et al.
(Continued)

*Primary Examiner* — D. Andrews
(74) *Attorney, Agent, or Firm* — Sean Christian Connolly

(57) ABSTRACT

Disclosed herein are various embodiments relating generally to a system for lifting water from an aquifer formation by drilling a u-shaped well through the aquifer formation, which comprises a water well screen within the aquifer formation with an inner production string with a series of check valves within the aquifer formation that allow water from the aquifer to flow from the water well screen and into the production string while preventing the water from leaving the production string, and then uses air pressure to force the water through a larger check valve in the production string, so that it may be collected in a surface tank. When not extracting water from the aquifer formation, the system allows treated water to be pumped into the outer casing and back into the aquifer, thereby recharging the aquifer formation with water.

2 Claims, 9 Drawing Sheets

(56) References Cited

U.S. PATENT DOCUMENTS

| | | | |
|---|---|---|---|
| 6,851,473 | B2 | 2/2005 | Davidson |
| 7,600,567 | B2 | 10/2009 | Christopher et al. |
| 7,854,261 | B2 | 12/2010 | Woie et al. |
| 8,011,446 | B2 | 9/2011 | Wylie et al. |
| 8,372,274 | B2 | 2/2013 | Early et al. |
| 8,658,043 | B2 | 2/2014 | Wilkins et al. |
| 8,871,089 | B2 | 10/2014 | Early et al. |
| 9,120,133 | B2 | 9/2015 | Brunner |
| 9,231,267 | B2 | 1/2016 | McAlister |
| 9,352,979 | B2 | 5/2016 | Kuennen et al. |
| 9,772,261 | B2 | 9/2017 | Angelescu et al. |
| 10,029,927 | B2 | 7/2018 | Murtha et al. |
| 10,683,742 | B2 | 6/2020 | Elmer |
| 10,798,886 | B2 | 10/2020 | Russell |
| 2009/0090510 | A1 | 4/2009 | Murphy et al. |
| 2010/0051546 | A1 | 3/2010 | Vuong et al. |
| 2010/0276369 | A1 | 11/2010 | Haag |
| 2015/0072400 | A1 | 3/2015 | Clarke |
| 2017/0074043 | A1 | 3/2017 | Carter |
| 2019/0367385 | A1 | 12/2019 | Kelada |
| 2020/0003232 | A1 | 1/2020 | Bergstrom et al. |
| 2020/0232309 | A1 | 7/2020 | Deutch et al. |
| 2020/0399143 | A1 | 12/2020 | Bitterly et al. |

* cited by examiner

PNEUMATIC LIFT AND RECHARGE SYSTEM FOR HORIZONTAL WATER WELLS

CROSS-REFERENCE TO RELATED APPLICATIONS

This application claims benefit of U.S. Provisional Patent Application No. 63/389,199, which was filed on Jul. 14, 2022, and which is incorporated herein in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention is in the technical field of wells. More particularly, the preferred embodiments of the present invention relate generally to water wells. More particularly, the preferred embodiments of the present invention relate generally to u-shaped water wells. More particularly, the preferred embodiments of the present invention relate generally to water wells, which extract water from aquifers. More particularly, the preferred embodiments of the present invention relate generally to water wells, which extract water from aquifers using air pressure. More particularly, the preferred embodiments of the present invention relate generally to water wells, which extract water from aquifers using air pressure and check valves. More particularly, the preferred embodiments of the present invention relate generally to water wells, which extract water from aquifers using air pressure and check valves, and which allow for the aquifers to be recharged using treated waste water.

2. Description of the Related Art

As cities, towns, and developments expand and grow, there is an ever-increasing need to provide potable water to the inhabitants. This need is greater in arid regions or regions that are suffering from drought, where surface water becomes increasingly scarce. Furthermore, surface water stored in reservoirs or lakes is subject to evaporation, especially in climate with warm temperatures. Often, potable water is collected from an aquifer using a well, or the like; however, rapid consumption of groundwater can drain aquifers and require deeper and deeper wells to access potable water, which may become problematic. There is a need to provide an efficient means of extracting groundwater from aquifer formations, as well as, a need to store treated water, which prevents loss from evaporation.

The broad concept of wells is generally known. However, most of these wells require natural pressure or expensive pumps to extract fluids, such as potable water.

U-shaped components in wells are known as well. However, these components also rely on natural pressure, fluid injection, or expensive extract methods to recover material from the wells with u-shaped components.

Additionally, the use of air or gas pressure in wells is known; however, this air or gas pressure is usually difficult to control and is subject to leaking through natural fractures in wells.

Further, it is known to use of perforated components in wells. However, these perforated components are limited to using natural pressure for fluid extraction and have disadvantages because the perforations lack means to direct or control flow through the perforations.

Moreover, the use of check valves in wells is known. However, although these check valves restrict flow to one direction, natural pressure or expensive pumps are required to extract fluids, such as potable water, from one side of the check valves.

Thus, what is needed is a solution for efficiently extracting water from an aquifer, as well as, adding treated water to an aquifer for storage, thereby recharging the aquifer, without the limitations of conventional techniques.

SUMMARY OF THE INVENTION

The Pneumatic Lift and Recharge System for Horizontal Water Wells invention was developed in part to provide a system for efficiently collecting potable water from an aquifer formation, as well as, for recharging the aquifer formation by storing water within it. In broad embodiment, the Pneumatic Lift and Recharge System for Horizontal Water Wells invention relates to a system for lifting water from an aquifer formation by drilling a u-shaped well through the aquifer formation, which comprises a screened outer casing within the aquifer formation with an inner production string with a series of check valves within the aquifer formation that allow water from the aquifer to flow from the screened outer casing and into the production string while preventing the water from leaving the production string, and then uses air pressure to force the water through a larger check valve in the production string, so that it may be collected in a storage tank. When not extracting water from the aquifer formation, the system allows treated water to be pumped into the outer casing and back into the aquifer, thereby recharging the aquifer formation with water.

In more detail, the well is drilled down from the surface, then between 500 feet to 7,500 feet horizontally into the aquifer formation, depending on the yield desired, and then back to the surface. A screen is then run through the full length of the aquifer. A protective slotted casing surrounding the screen protects the inside of the screen. Sand pack could be inserted via tubing pulled through with a wireline from the opposite side. Next, casing is pulled through using a wireline from the entrance to the terminus. Casing size can vary based upon the need of the well. Inside the casing is an eight-inch steel production string, although it could be sized differently depending on the size of the well. The production string comprises a series of check valves spaced approximately two to ten feet apart, oriented horizontally, along the length of the production string and located inside the casing. The series of check valves only allow water to flow from outside the production string to the inside. Once water is inside the production string it is not allowed to escape except through the surface at the production side of the well. An eight-inch check valve is located on the production string at the end of the section with the smaller check valves, which does not allow water to flow back to the section of the production string with the series of smaller check valves. Water is raised from the aquifer by releasing pressurized air into the production string. Once the water column is raised to surface and the pressure is released on the water column, it is held to the surface by the this larger, in-line check valve. The concept works because of the shape of the well bore. As air pressure is increased on the pressure side of the well bore, the corresponding volume of water is displaced from the production side of the well bore to the surface. This water then goes to a storage tank to be fed in distribution. The pressurized side of the production string is filled with air until a water level indicator sends a signal to close the valve, which allows the pressurized air to enter the production string. Once maximum displacement has occurred, an air release valve releases the compressed air from the production string, which then allows water to enter the production string from the aquifer formation through the series of small check valves. The pneumatic system comprises a pneumatic storage tank with a high capacity air compressor. When water is called for by a low level sensor, the control system opens a valve located between the pneumatic tank and the production string. The valve opens and displaces the water in the production string. Air continues pressurizing the production string until the level sensor in the well signals the air valve to close. The pressure relief valve on the well head releases the pressurized air in the production string, thus allowing the production string to depressurize. When the well is not in use for extracting water from the aquifer formation, both production and pressure side have a three-inch inlet on the well seal, which allows water, such as that from a water treatment plant, to be returned down the annulus to recharge the aquifer. An air valve located on the back side of the production string may be used to accelerate the recharge rate.

In a preferred embodiment, the present invention relates broadly to a pneumatic lift and recharge system for a horizontal water well extending through an aquifer formation, said system comprising: a well head charger end, said well head charger end being located at ground level, said well head charger end comprising: a well head; a pneumatic tank; an air compressor, said air compressor being able to pressurize said pneumatic tank; an air valve, said air valve being connected between said pneumatic tank and said well head; and a pressure release valve, said pressure release valve being connected to said well head; a well head production end, said well head production end being located at said ground level, said well head production end comprising: a production head, and a ground storage tank, said ground storage tank being connected to said production head; a well, said well being u-shaped and extending from said well head, substantially horizontally through said aquifer formation, and to said production head, said well comprising: a pressure portion, said pressure portion being a first portion of said well between said well head and said aquifer formation; an aquifer portion, said aquifer portion being a second portion of said well within said aquifer formation; a production portion, said production portion being a third portion of said well between said aquifer formation and said production head; a lateral casing, said lateral casing being within said well and extending from said well head to said production head, said lateral casing comprising: a plurality of perforations within said aquifer portion of said well, said perforations being capable of allowing water to flow between said aquifer formation and said lateral casing; and a production string, said production string being within said lateral casing within said well, extending between said well head and said production head, and connected to said well head and said production head, said production string comprising: a high level sensor, said high level sensor being installed within said production string within said pressure portion and capable of detecting a high water level; a low level sensor, said low level sensor being installed within said production string within said pressure portion and capable of detecting a low water level; a plurality of aquifer check valves, said aquifer check valves being installed along said production string within said aquifer portion and being capable of allowing said water from said aquifer formation within said lateral casing to enter said production string while preventing said water from exiting said production string into said lateral casing; and a production check valve, said production check valve being installed within said production string between said aquifer portion and said production portion and capable of allowing said water from within said production string in said aquifer portion to flow into said production string within said production portion while preventing said water from reentering said production string within said aquifer portion; and a control module, said control module being able to control and interact with said air compressor, said air valve, said high level sensor, said low level sensor, and said pressure release valve; wherein said water naturally flows from said aquifer formation into said lateral casing through said perforations; wherein said water flows from said lateral casing to said production string through said aquifer check valves; wherein said air compressor controlled by said control module pressurizes said pneumatic tank; wherein, when said high level sensor detects said high water level in said production string in said pressure portion, said control module closes said pressure release valve and opens said air valve between said pneumatic tank and said production string, thereby pressurizing said production string in said pressure portion and forcing said water in said production string through said large check valve and into said production string in said production portion; wherein, when said low level sensor detects said low water level in said production string in said pressure portion, said control module closes said air valve between said pneumatic tank and said well head and opens said pressure release valve, thereby releasing the pressure in said production string and allowing said water to enter said production string within said aquifer portion from said lateral casing through said small check valves and allowing said air compressor to repressurize said pneumatic tank; and wherein said control module repeats opening and closing said air valve and said pressure release valve in response to said high level sensor and said low level sensor until said ground storage tank is filled with said water from said production portion of said production string in order to use said water for distribution.

In the most preferred embodiment, the present invention relates broadly to a pneumatic lift and recharge system for a horizontal water well extending through an aquifer formation, said system comprising: a well head charger end, said well head charger end being located at ground level, said well head charger end comprising: a well head; a pneumatic tank; an air compressor, said air compressor being able to pressurize said pneumatic tank; an air valve, said air valve being connected between said pneumatic tank and said well head; a pressure release valve, said pressure release valve being connected to said well head; and a first recharge inlet; a well head production end, said well head production end being located at said ground level, said well head production end comprising: a production head, a ground storage tank, said ground storage tank being connected to said production head; and a second recharge inlet; a well, said well being u-shaped and extending from said well head, substantially horizontally through said aquifer formation, and to said production head, said well comprising: a pressure portion, said pressure portion being a first portion of said well between said well head and said aquifer formation; an aquifer portion, said aquifer portion being a second portion of said well within said aquifer formation; a production portion, said production portion being a third portion of said well between said aquifer formation and said production head; a lateral casing, said lateral casing being within said well and extending from said well head to said production head and connected to said first recharge inlet and said second recharge inlet, said lateral casing comprising: a plurality of perforations within said aquifer portion of said well, said perforations being capable of allowing water to flow from said aquifer formation to said lateral casing; and a production string, said production string being within said lateral casing within said well, extending between said well head and said production head, and connected to said well head and said production head, said production string comprising: a high level sensor, said high level sensor being installed within said production string within said pressure portion and capable of detecting a high water level; a low level sensor, said low level sensor being installed within said production string within said pressure portion and capable of detecting a low water level; a plurality of aquifer check valves, said aquifer small check valves being installed along said production string within said aquifer portion and being capable of allowing said water from said aquifer formation within said lateral casing to enter said production string while preventing said water from exiting said production string into said lateral casing; and a production check valve, said production check valve being installed within said production string between said aquifer portion and said production portion and capable of allowing said water from within said production string in said aquifer portion to flow into said production string within said production portion while preventing said water from reentering said production string within said aquifer portion; and a control module, said control module being able to control and interact with said air compressor, said air valve, said high level sensor, said low level sensor, said pressure release valve, said first recharge inlet, and said second recharge inlet; wherein said water naturally flows from said aquifer formation into said lateral casing through said perforations; wherein said water flows from said lateral casing to said production string through said aquifer check valves; wherein said air compressor controlled by said control module pressurizes said pneumatic tank; wherein, when said high level sensor detects said high water level in said production string in said pressure portion, said control module closes said pressure release valve and opens said air valve between said pneumatic tank and said production string, thereby pressurizing said production string in said pressure portion and forcing said water in said production string through said production check valve and into said production string in said production portion; wherein, when said low level sensor detects said low water level in said production string in said pressure portion, said control module closes said air valve between said pneumatic tank and said well head and opens said pressure release valve, thereby releasing the pressure in said production string and allowing said water to enter said production string within said aquifer portion from said lateral casing through said aquifer check valves and allowing said air compressor to repressurize said pneumatic tank; wherein said control module repeats opening and closing said air valve and said pressure release valve in response to said high level sensor and said low level sensor until said ground storage tank is filled with said water from said production portion of said production string in order to use said water for distribution; and wherein, when said horizontal water well is not in use, said first recharge inlet and said second recharge inlet controlled by said control module allow treated waste water to enter said lateral casing, thereby storing said treated waste water in said aquifer formation and recharging said aquifer formation.

Although the foregoing examples have been described in some detail for purposes of clarity of understanding, the above-described inventive techniques are not limited to the details provided. There are many alternative ways of implementing the above-described invention techniques. The disclosed examples are illustrative and not restrictive. These embodiments are not intended to limit the scope of the present invention.

BRIEF DESCRIPTION OF THE DRAWING

Illustrative and preferred embodiments of the present invention are shown in the accompanying drawings in which.

DETAILED DESCRIPTION OF THE PREFERRED EMBODIMENTS

For the purpose of illustration, the present invention is shown in the preferred embodiments of a pneumatic lift and recharge system for a horizontal water well, which extends through an aquifer formation, for extracting water using air pressure. In broad embodiment, the present invention comprises a system for lifting water from an aquifer formation by drilling a u-shaped well through the aquifer formation, which comprises an outer casing that is perforated within the aquifer formation with an inner production string with a series of check valves within the aquifer formation that allow water from the aquifer to flow from the perforated casing and into the production string while preventing the water from leaving the production string, and then uses air pressure to force the water through a larger check valve in the production string, so that it may be collected in a surface tank. Additional embodiments allow treated water to be pumped into the outer casing and back into the aquifer, thereby recharging the aquifer formation with water, when not extracting water from the aquifer formation. In general, operations of disclosed processes may be performed in an arbitrary order, unless otherwise provided in the claims. These embodiments are not intended to limit the scope of the present invention.

A detailed description of one or more examples is provided below along with accompanying figures. The detailed description is provided in connection with such examples, but is not limited to any particular example. The scope is limited only by the claims, and numerous alternatives, modifications, and equivalents thereof. Numerous specific details are set forth in the following description in order to provide a thorough understanding. These details are provided for the purpose of example and the described techniques may be practiced according to the claims without some or all of these specific details. For clarity, technical material that is known in the technical fields related to the examples has not been described in detail to avoid unnecessarily obscuring the description.

Figure 1:
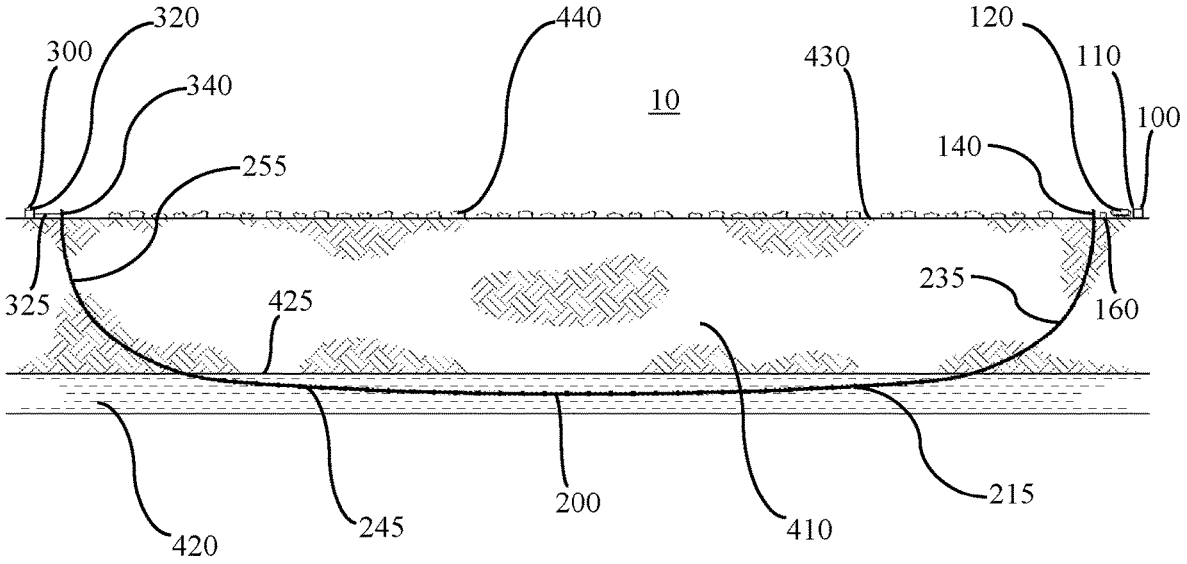
FIG. 1 is a side cutaway view of the system of the present invention, according to some examples.
Figure 2:
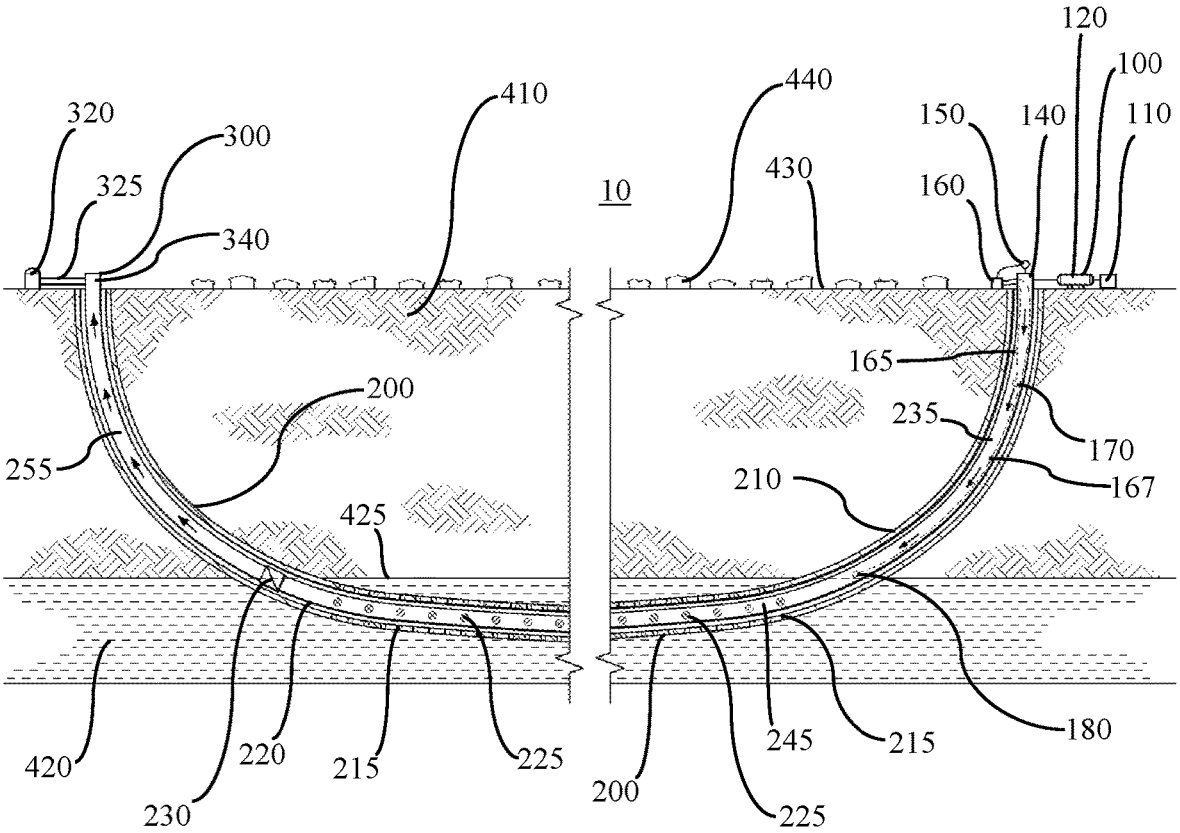
FIG. 2 is closeup side cutaway view of the system of FIG. 1, according to some examples.
Figure 3:
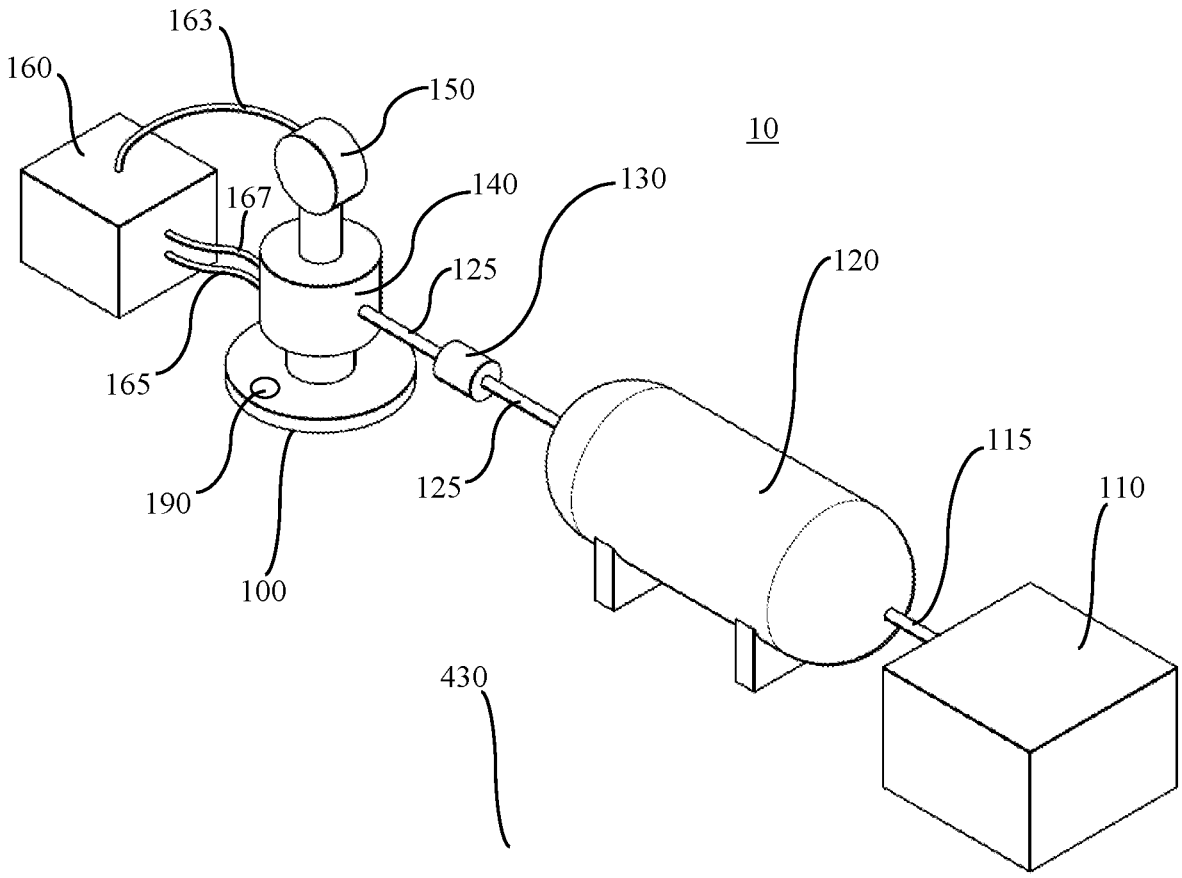
FIG. 3 is a perspective view of a well head charger end of the system of FIG. 1, according to some examples.
Figure 4:
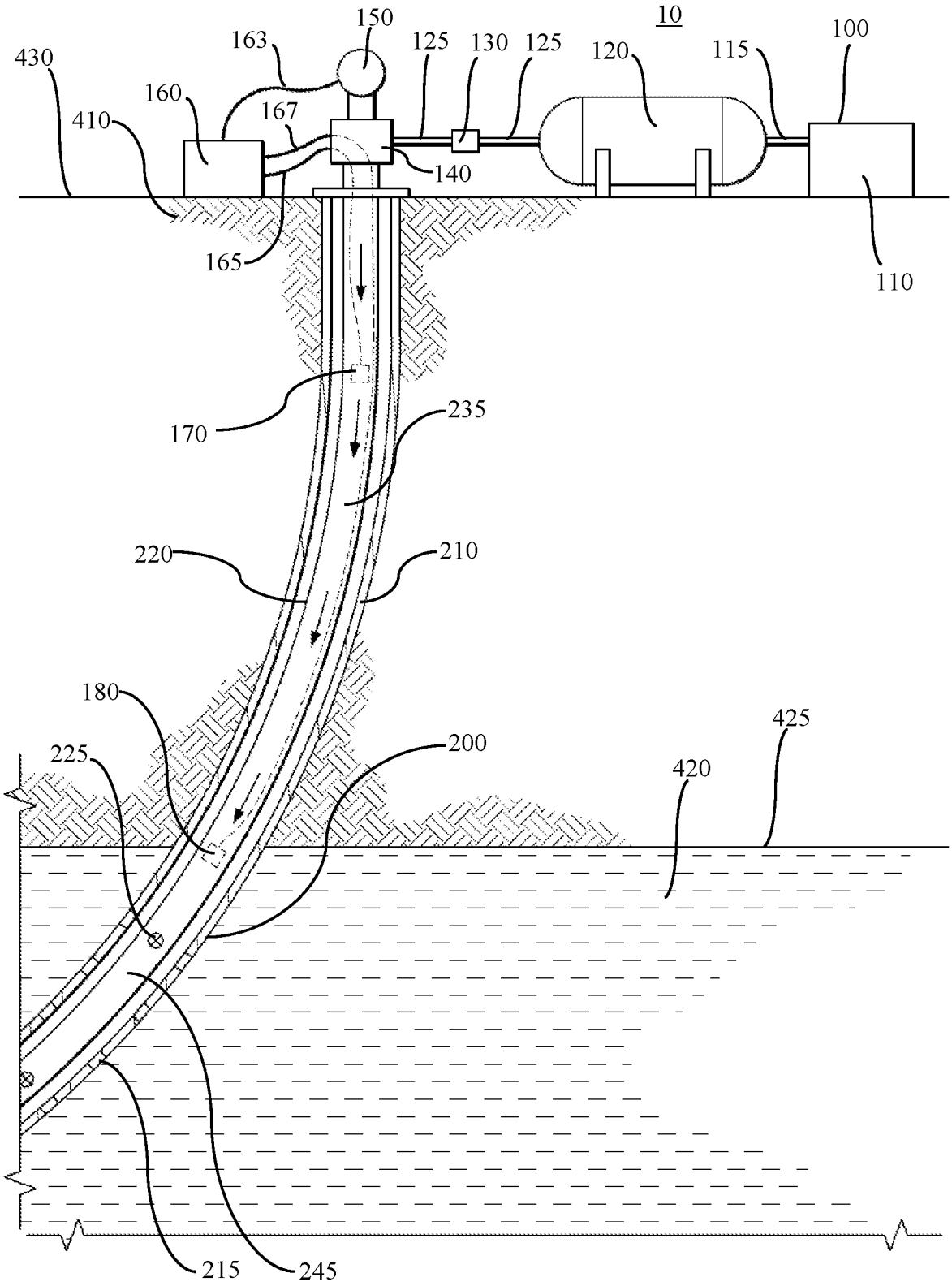
FIG. 4 is a closeup side cutaway view of a well head charger end, pressure portion, and aquifer portion of the system of the present invention, according to some examples.
Figure 5:
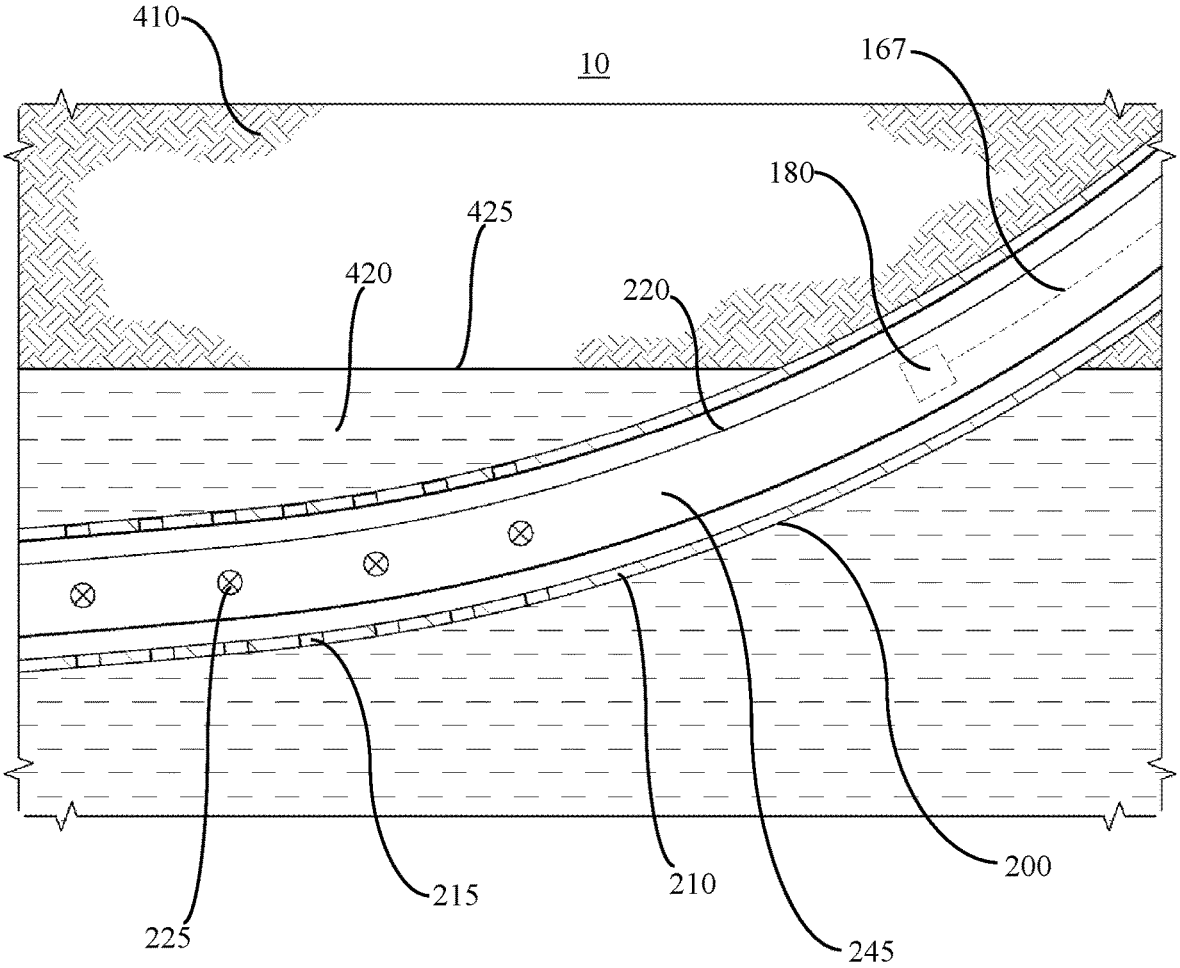
FIG. 5 is a closeup side cutaway view of a pressure portion and aquifer portion of the system of the present invention, according to some examples.
Figure 6:
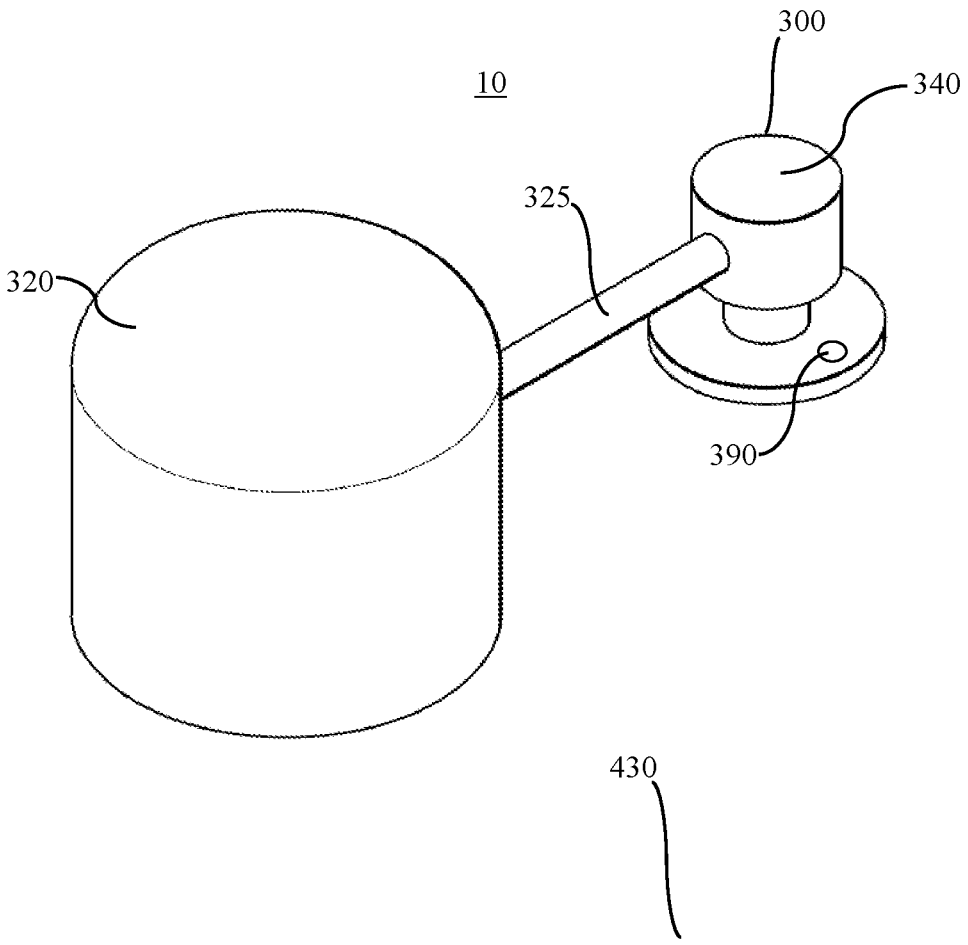
FIG. 6 is a perspective view of a well head production end of the system of FIG. 1, according to some examples.
Figure 7:
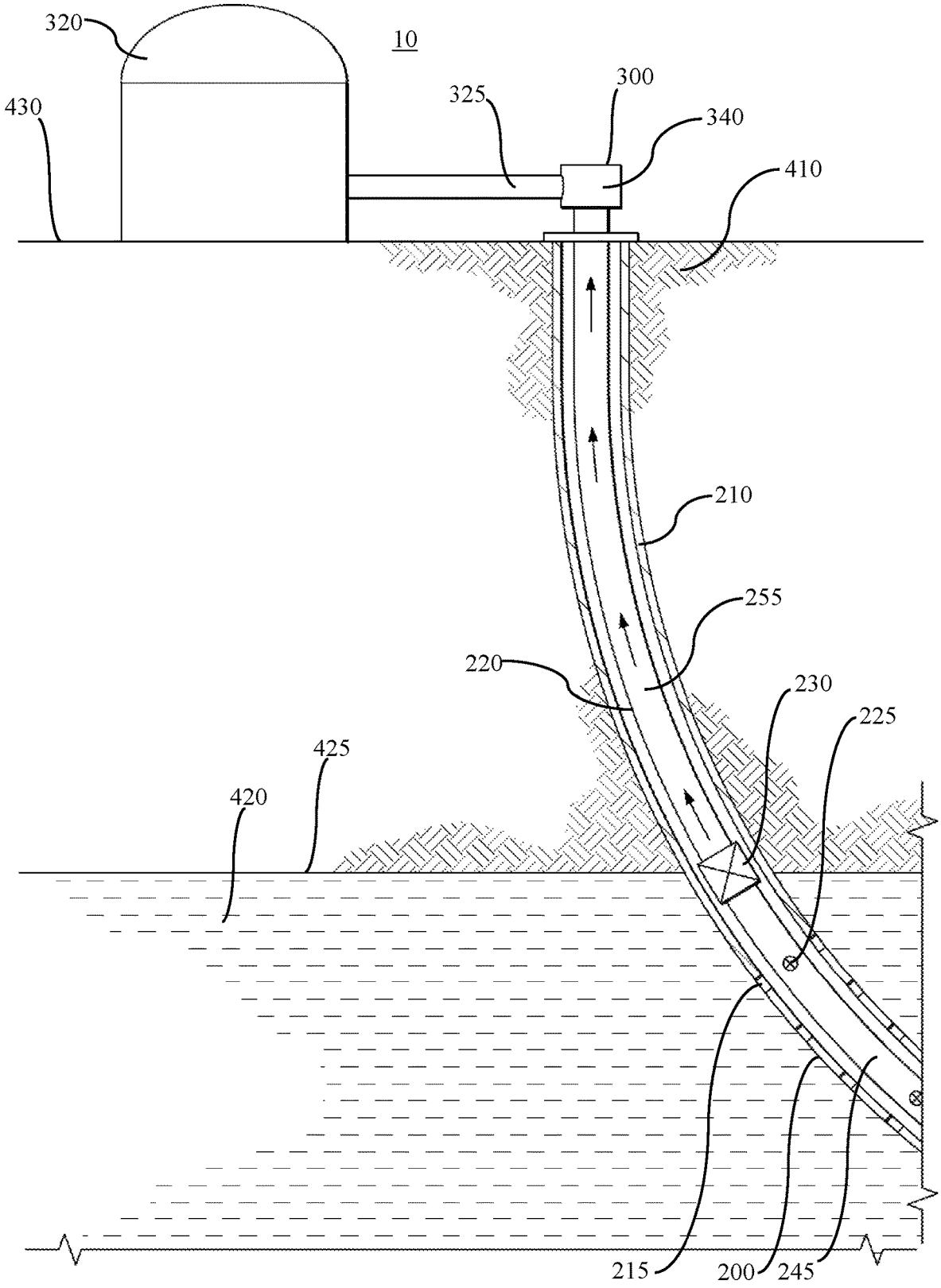
FIG. 7 is a closeup side cutaway view of a well head production end, production portion, and aquifer portion of the system of the present invention, according to some examples.
Figure 8:
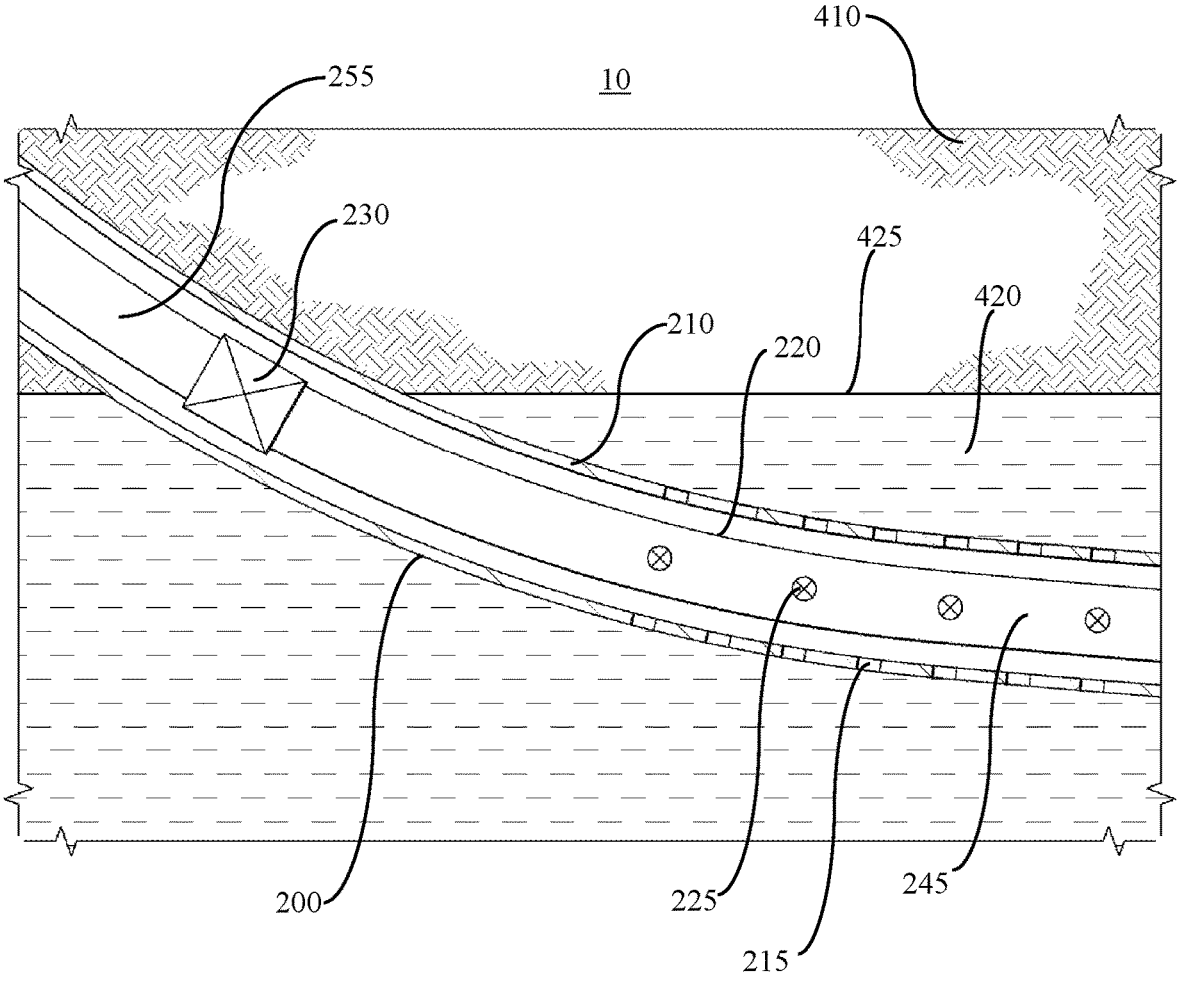
FIG. 8 is a closeup side cutaway view of a production portion and aquifer portion of the system of the present invention, according to some examples.
Figure 9:
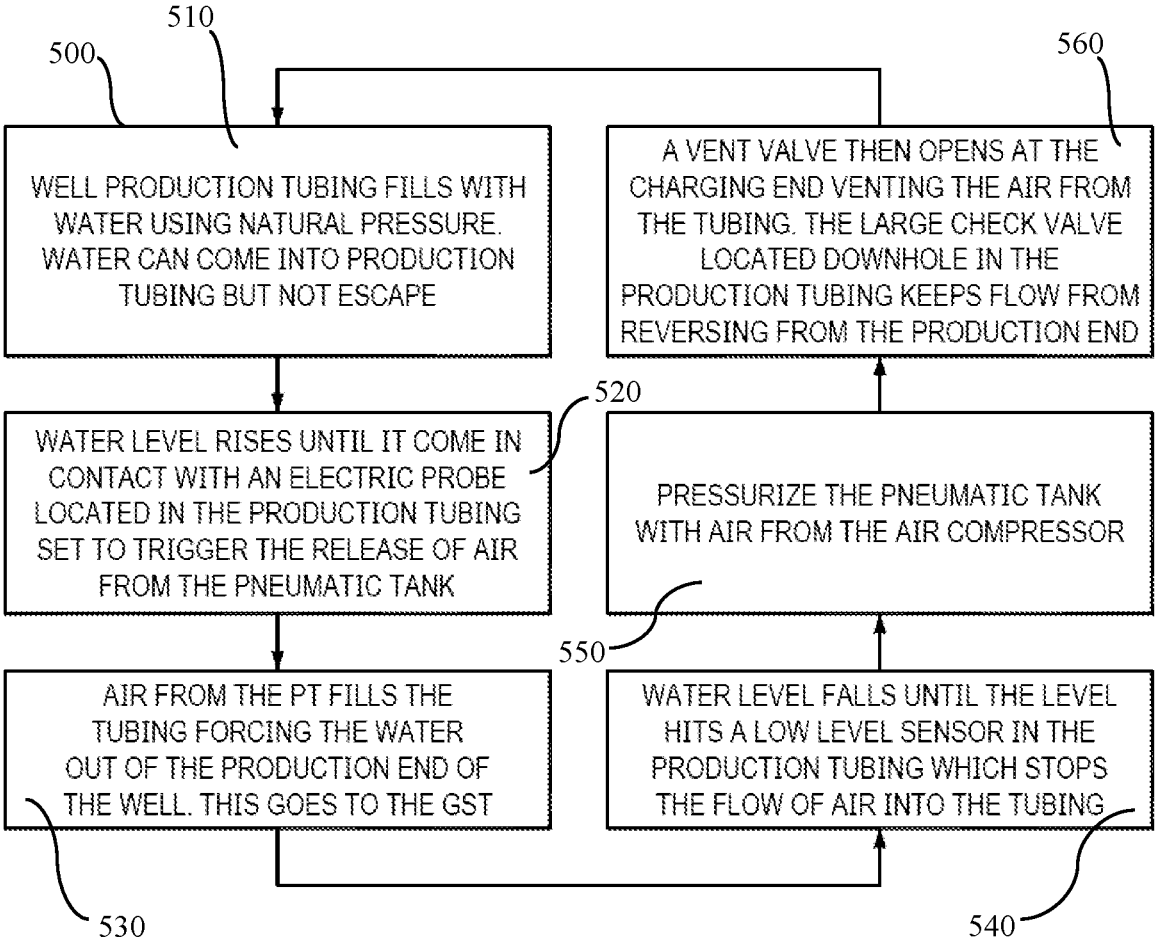
FIG. 9 is a flowchart depicting the process of a system of FIG. 1, according to various embodiments.

Referring now to the most preferred embodiment of the present invention, FIG. 1, FIG. 2, FIG. 3, FIG. 4, FIG. 5, FIG. 6, FIG. 7, FIG. 8, and FIG. 9, illustrate a Pneumatic Lift and Recharge System for Horizontal Water Wells 10. FIG. 1 shows a side cutaway view of a Pneumatic Lift and Recharge System for Horizontal Water Wells 10 arranged between houses 440, including a well head charger end 100 and a well head production end 300 at ground level 430; a pressure portion 235 and a production portion 255 of a well 200 in a subterranean region 410, and an aquifer portion 245 of a well 200 below the aquifer boundary 425 in an aquifer formation 420. FIG. 2 depicts a closeup side cutaway view of a Pneumatic Lift and Recharge System for Horizontal Water Wells 10. FIG. 3 displays a perspective view of a well head charger end 100 of a Pneumatic Lift and Recharge System for Horizontal Water Wells 10. FIG. 4 shows a closeup side cutaway view of a well head charger end 100, a pressure portion 235, and an aquifer portion 245 of a well 200 of a Pneumatic Lift and Recharge System for Horizontal Water Wells 10. FIG. 5 illustrates a closeup side cutaway view of a pressure portion 235 and aquifer portion 245 of a well 200 of a Pneumatic Lift and Recharge System for Horizontal Water Wells FIG. 6 displays a perspective view of a well head production end 300 of the system of Pneumatic Lift and Recharge System for Horizontal Water Wells 10. FIG. 7 shows a closeup side cutaway view of a well head production end 300, a production portion 255, and an aquifer portion 245 of a well 200 of a Pneumatic Lift and Recharge System for Horizontal Water Wells FIG. 8 depicts a closeup side cutaway view of a production portion 255 and aquifer portion 245 of a well 200 of a Pneumatic Lift and Recharge System for Horizontal Water Wells 10. FIG. 9 illustrates a flowchart 500 depicting the process of a Pneumatic Lift and Recharge System for Horizontal Water Wells 10.

In further detail, referring to the invention of FIG. 1, FIG. 2, FIG. 3, FIG. 4, FIG. 5, FIG. 6, FIG. 7, FIG. 8, and FIG. 9, a Pneumatic Lift and Recharge System for Horizontal Water Wells 10 comprises a well head charger end 100, said well head charger end 100 being located at ground level 430, said well head charger end 100 comprising: a well head 140; a pneumatic tank 120; an air compressor 110, said air compressor 110 being able to pressurize said pneumatic tank 120 through an air compressor pipe 115; an air valve 130, said air valve 130 being connected between said pneumatic tank 120 and said well head 140 by an air valve pipe 125; a pressure release valve 150, said pressure release valve 150 being connected to said well head 140; and a first recharge inlet 190; a well head production end 300, said well head production end 300 being located at said ground level 430, said well head production end 300 comprising: a production head 340, a ground storage tank 320, said ground storage tank 320 being connected to said production head 340 though a ground storage tank pipe 325; and a second recharge inlet 390; a well 200, said well 200 being u-shaped and extending from said well head 140, substantially horizontally through an aquifer formation 420, and to said production head 340, said well 200 comprising: a pressure portion 235, said pressure portion 235 being a first portion of said well 200 between said well head 140 and said aquifer boundary 425 of said aquifer formation 420; an aquifer portion 245, said aquifer portion 245 being a second portion of said well 200 below said aquifer boundary 425 and within said aquifer formation 420; a production portion 255, said production portion 255 being a third portion of said well 200 between said aquifer boundary 425 of said aquifer formation 420 and said production head 340; a lateral casing 210, said lateral casing being within said well 200 and extending from said well head 140 to said production head 340 and connected to said first recharge inlet 190 and said second recharge inlet 390, said lateral casing 210 comprising: a plurality of perforations 215 within said aquifer portion 245 of said well 200, said perforations 215 being capable of allowing water to flow between said aquifer formation 420 and said lateral casing; and a production string 220, said production string 220 being within said lateral casing 210 within said well 200, extending between said well head 140 and said production head 340, and connected to said well head 140 and said production head 340, said production string 220 comprising: a high level sensor 170, said high level sensor 170 being installed within said production string 220 within said pressure portion 235 and capable of detecting a high water level within said production string 220; a low level sensor 180, said low level sensor 180 being installed within said production string 220 within said pressure portion 235 and capable of detecting a low water level within said production string 220; a plurality of aquifer check valves 225, said aquifer check valves 225 being installed along said production string 220 within said aquifer portion 245 and being capable of allowing said water from said aquifer formation 420 within said lateral casing 210 to enter said production string 220 while preventing said water from exiting said production string 220 into said lateral casing 210; and a production check valve 230, said production check valve 230 being installed within said production string 220 between said aquifer portion 245 and said production portion 255 and capable of allowing said water from within said production string 220 in said aquifer portion 245 to flow into said production string 220 within said production portion 255 while preventing said water from reentering said production string 220 within said aquifer portion 245; and a control module 160, said control module 160 being able to control and interact with said air compressor 110, said air valve 130, said high level sensor 170 through a high level sensor cable 165, said low level sensor 180 through a low level sensor cable 167, said pressure release valve 150 though a pressure release cable 163, said first recharge inlet 190, and said second recharge inlet 390; wherein said water naturally flows from said aquifer formation 420 into said lateral casing 210 through said perforations 215; wherein said water flows from said lateral casing 210 to said production string 220 through said aquifer check valves 225; wherein said air compressor 110 controlled by said control module 160 pressurizes said pneumatic tank 120; wherein, when said high level sensor 170 detects said high water level in said production string 220 in said pressure portion 235, said control module 160 closes said pressure release valve 150 and opens said air valve 130 between said pneumatic tank 120 and said production string 220, thereby pressurizing said production string 220 in said pressure portion 235 and forcing said water in said production string 220 through said production check valve 230 and into said production string 220 in said production portion 255; wherein, when said low level sensor 180 detects said low water level in said production string 220 in said pressure portion 235, said control module 160 closes said air valve 130 between said pneumatic tank 120 and said well head 140 and opens said pressure release valve 150, thereby releasing the pressure in said production string 220 and allowing said water to enter said production string 220 within said aquifer portion 245 from said lateral casing 210 through said aquifer check valves 225 and allowing said air compressor 110 to repressurize said pneumatic tank 120; wherein said control module 160 repeats opening and closing said air valve 130 and said pressure release valve 150 in response to said high level sensor 170 and said low level sensor 180 until said ground storage tank 320 is filled with said water from said production portion 255 of said production string 220 in order to use said water for distribution; and wherein, when said horizontal water well is not in use, said first recharge inlet 190 and said second recharge inlet 390 controlled by said control module 160 allow treated waste water to enter said lateral casing 210, thereby storing said treated waste water in said aquifer formation 420 and recharging said aquifer formation 420.

In further detail, still referring to the invention of FIG. 1, FIG. 2, FIG. 3, FIG. 4, FIG. 5, FIG. 6, FIG. 7, FIG. 8, and FIG. 9, in FIG. 9, a flowchart 500 describes the process undergone by a Pneumatic Lift and Recharge System for Horizontal Water Wells 10. During use of the Pneumatic Lift and Recharge System for Horizontal Water Wells 10, the first step in the flowchart 500 is the filling step 510 in which the well production tubing, or production string 220, is filled with water from the aquifer formation 420 using natural pressure. The water enters into the production tubing, or production string 220, through the aquifer check valves 225, but it cannot escape because the aquifer check valves 225 only allow water to enter into the production string 220. In the next step of the flowchart 500, the rising step 520, the water level in the production string 220 rises until it comes in contact with an electrical probe located in the production tubing, or production string 220, which is set to trigger the release of pressurized air from the pneumatic tank 120. In the next step of the flowchart 500, the pump step 530, pressurized air from the PT, or pneumatic tank 120, fills the tubing of the production string 120, thereby forcing the water through the production check valve 230 and into the production string 220 in the production portion 255 of the well 200, through the production head 340 and into the GST, or ground storage tank 320. In the next step of the flowchart 500, the low level step 540, the water level in the production string 220 falls until the level hits the low level sensor 180, which causes the control module 160 to close the air value 130, thereby stopping the pressurized air from flowing into the production string 220. In the next step of the flowchart 500, the pressurize step 550, the control module 160 activates the air compressor 110 in order to pressurize the pneumatic tank 120. In the next step of the flowchart 500, the venting step 560, the control module 160 opens the vent valve, or pressure release valve 150, which vents compressed air from the tubing, or production string 220, and the large check valve, or production check valve 230, in the production string 220 keeps the water flow from reversing from the production portion 255 of the production string 220 back into the aquifer portion 245 of the production string 220. Next, after venting the production string 220, the filling step 510 of the flow chart 500 starts again, and the process is repeated until the ground storage tank 320 is filled with water for distribution.

The construction details of the invention as shown in FIG. 1, FIG. 2, FIG. 3, FIG. 4, FIG. 5, FIG. 6, FIG. 7, FIG. 8, and FIG. 9, are as follows. The well head charger end 100 comprises the air compressor 110, air compressor pipe 115, pneumatic tank 120, air valve pipe 125, air valve 130, well head 140, pressure release valve 150, control module 160, high level sensor cable 165, low level sensor cable 167, pressure release cable 163, and first recharge inlet 190. The well head production end 300 comprises the production head 340, ground storage tank 320, ground storage tank pipe 325, and second recharge inlet 390. The ground level 430 comprises the surface of the ground. The subterranean region 410 comprises the ground below the ground level 430. The aquifer formation 420 comprises a portion of the subterranean region 410 below the aquifer boundary 425, which is saturated with water. The aquifer boundary 425 comprises the upper boundary of an aquifer formation 420, below which water is found. The well 200 comprises a cavity, hollow, opening, space, void, hole, tube, or the like, cut, drilled, or excavated into the subterranean region 410 and extending from ground level 430, substantially horizontally through an aquifer formation 420, preferably 2,500 feet to 7,500 feet horizontally, and back to ground level 430. The pressure portion 235 comprises the portion of the well 200, and elements within the well 200, which are between the well head 140 and the aquifer formation 420. The aquifer portion 245 comprises the portion of the well 200, and elements within the well 200, which are under the aquifer boundary 425 and within the aquifer formation 420. The production portion 255 comprises the portion of the well 200, and elements within the well 200, between the aquifer formation 420 and the production head 340. The a well head 140 comprises metal, steel, copper, plastic, high density plastic, silicone, PVC, fiber glass, carbon fiber, composite material, galvanized steel, stainless steel, aluminum, brass, copper, or other like material. The pneumatic tank 120 comprises a tank capable of holding pressurized air and comprises metal, steel, copper, plastic, high density plastic, silicone, PVC, fiber glass, carbon fiber, composite material, galvanized steel, stainless steel, aluminum, brass, copper, or other like material. The air compressor 110 comprises a standard air compressor. The air compressor pipe 115 comprises metal, steel, copper, plastic, high density plastic, silicone, PVC, fiber glass, carbon fiber, composite material, galvanized steel, stainless steel, aluminum, brass, copper, or other like material. The air valve 130 comprises a standard valve, switch, regulator, controller, stopcock, or the like. The air valve pipe 125 comprises metal, steel, copper, plastic, high density plastic, silicone, PVC, fiber glass, carbon fiber, composite material, galvanized steel, stainless steel, aluminum, brass, copper, or other like material. The pressure release valve 150 comprises a standard valve, switch, regulator, controller, stopcock, or the like. The first recharge inlet 190 comprises a hole, hose, opening, pipe, connection, valve, faucet, spigot, or the like. The production head 340 comprises metal, steel, copper, plastic, high density plastic, silicone, PVC, fiber glass, carbon fiber, composite material, galvanized steel, stainless steel, aluminum, brass, copper, wood, or other like material. The ground storage tank 320 comprises a tank that can hold water or potable water and comprises metal, steel, copper, plastic, high density plastic, silicone, PVC, fiber glass, carbon fiber, composite material, galvanized steel, stainless steel, aluminum, brass, copper, wood, or other like material. The ground storage tank pipe 325 comprises metal, steel, copper, plastic, high density plastic, silicone, PVC, fiber glass, carbon fiber, composite material, galvanized steel, stainless steel, aluminum, brass, copper, wood, or other like material. The second recharge inlet 390 comprises a hole, hose, opening, pipe, connection, valve, faucet, spigot, or the like. The lateral casing 210 is preferably 16 inches in diameter and comprises holes, perforations 215, openings, slotted casing, screens, metal, steel, copper, plastic, high density plastic, silicone, PVC, fiber glass, carbon fiber, composite material, galvanized steel, stainless steel, aluminum, brass, copper, or other like material. The perforations 215 comprise holes, openings, slotted casing, screens, apertures, spaces, or other means that allow water to flow though, or the like. The production string 220 is preferably 8 inches in diameter and comprises aquifer check valves 225, production check valve 230, high level sensor 170, low level sensor 180, metal, steel, copper, plastic, high density plastic, silicone, PVC, fiber glass, carbon fiber, composite material, galvanized steel, stainless steel, aluminum, brass, copper, or other like material. The high level sensor 170 comprises an electrical sensor, a digital sensor, a water level sensor, a sounder, a pneumatic sensor, or the like. The low level sensor 180 comprises an electrical sensor, a digital sensor, a water level sensor, a sounder, a pneumatic sensor, or the like. The aquifer check valves 225 are preferably 1 inch to 2 inches, set preferably at two-foot, four-foot, or ten-foot intervals, or the like, along the production string 220 within the aquifer portion 245, and comprise small check valves, which only allow water to flow one way, or the like. The production check valve 230 is preferably 8 inches and comprises a larger check valve, which only allows water to flow one way, or the like. The control module 160 comprises a computer, a processor, switch board, signal processor, electrical box, or the like. The high level sensor cable 165 comprises metal, steel, copper, galvanized steel, stainless steel, aluminum, brass, copper, protective covering, or other like material. The low level sensor cable 167 comprises metal, steel, copper, galvanized steel, stainless steel, aluminum, brass, copper, protective covering, or other like material. The pressure release cable 163 comprises metal, steel, copper, galvanized steel, stainless steel, aluminum, brass, copper, protective covering, or other like material. Although the foregoing examples of materials have been described in some detail for purposes of clarity of understanding, the above-described materials are not limited to the details provided. There are many alternative ways of implementing the above-described invention. The disclosed examples are illustrative and not restrictive. These materials are not intended to limit the scope of the present invention.

The advantages of the present invention include, without limitation, that it provides an efficient and cost effective means of extracting potable water from an aquifer using air pressure and check valves; that it efficiently provides potable water to the inhabitants in a cost effective manner; that it can provide potable water in arid regions or regions that are suffering from drought, where surface water becomes increasingly scarce; that is can prevent the loss of stored water through evaporation, especially in climates with warm temperatures; and that it extends the use of an aquifer by allowing the aquifer to be recharged with treated water. Overall, the present invention offers improved water extraction from an aquifer using air pressure, which is efficient and relatively inexpensive, as well as a means of storing treated water in an aquifer, thereby recharging the aquifer and preventing water loss through surface evaporation.

In broad embodiment, the present invention relates generally to a system for lifting water from an aquifer formation by drilling a u-shaped well through the aquifer formation, which comprises an outer casing that is perforated within the aquifer formation with an inner production string with a series of check valves within the aquifer formation that allow water from the aquifer to flow from the perforated casing and into the production string while preventing the water from leaving the production string, and then uses air pressure to force the water through a larger check valve in the production string, so that it may be collected in a surface tank. In addition, other broad embodiments allow treated water to be pumped into the outer casing and back into the aquifer, thereby recharging the aquifer formation with water. These embodiments are not intended to limit the scope of the present invention.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiments, methods, and examples, but by all embodiments and methods that are within the scope and spirit of the invention as claimed.

What is claimed is:

1. A pneumatic lift and recharge system for a horizontal water well extending through an aquifer formation, said system comprising:

a well head charger end, said well head charger end being located at ground level, said well head charger end comprising:
- a well head;
- a pneumatic tank;
- an air compressor, said air compressor being able to pressurize said pneumatic tank;
- an air valve, said air valve being connected between said pneumatic tank and said well head; and
- a pressure release valve, said pressure release valve being connected to said well head;

a well head production end, said well head production end being located at said ground level, said well head production end comprising:
- a production head, and
- a ground storage tank, said ground storage tank being connected to said production head;

a well, said well being u-shaped and extending from said well head, substantially horizontally through said aquifer formation, and to said production head, said well comprising:
- a pressure portion, said pressure portion being a first portion of said well between said well head and said aquifer formation;
- an aquifer portion, said aquifer portion being a second portion of said well within said aquifer formation;
- a production portion, said production portion being a third portion of said well between said aquifer formation and said production head;
- a lateral casing, said lateral casing being within said well and extending from said well head to said production head, said lateral casing comprising:
  - a plurality of perforations within said aquifer portion of said well, said perforations being capable of allowing water to flow between said aquifer formation and said lateral casing; and a production string, said production string being within said lateral casing within said well, extending between said well head and said production head, and connected to said well head and said production head, said production string comprising:

a high level sensor, said high level sensor being installed within said production string within said pressure portion and capable of detecting a high water level;

a low level sensor, said low level sensor being installed within said production string within said pressure portion and capable of detecting a low water level;

a plurality of aquifer check valves, said aquifer check valves being installed along said production string within said aquifer portion and being capable of allowing said water from said aquifer formation within said lateral casing to enter said production string while preventing said water from exiting said production string into said lateral casing; and a production check valve, said production check valve being installed within said production string between said aquifer portion and said production portion and capable of allowing said water from within said production string in said aquifer portion to flow into said production string within said production portion while preventing said water from reentering said production string within said aquifer portion; and a control module, said control module being able to control and interact with said air compressor, said air valve, said high level sensor, said low level sensor, and said pressure release valve;

wherein said water naturally flows from said aquifer formation into said lateral casing through said perforations;

wherein said water flows from said lateral casing to said production string through said aquifer check valves;

wherein said air compressor controlled by said control module pressurizes said pneumatic tank;

wherein, when said high level sensor detects said high water level in said production string in said pressure portion, said control module closes said pressure release valve and opens said air valve between said pneumatic tank and said production string, thereby pressurizing said production string in said pressure portion and forcing said water in said production string through said production check valve and into said production string in said production portion;

wherein, when said low level sensor detects said low water level in said production string in said pressure portion, said control module closes said air valve between said pneumatic tank and said well head and opens said pressure release valve, thereby releasing the pressure in said production string and allowing said water to enter said production string within said aquifer portion from said lateral casing through said aquifer check valves and allowing said air compressor to repressurize said pneumatic tank; and wherein said control module repeats opening and closing said air valve and said pressure release valve in response to said high level sensor and said low level sensor until said ground storage tank is filled with said water from said production portion of said production string in order to use said water for distribution.

2. A pneumatic lift and recharge system for a horizontal water well extending through an aquifer formation, said system comprising:

a well head charger end, said well head charger end being located at ground level, said well head charger end comprising:

a well head;

a pneumatic tank;

an air compressor, said air compressor being able to pressurize said pneumatic tank;

an air valve, said air valve being connected between said pneumatic tank and said well head;

a pressure release valve, said pressure release valve being connected to said well head; and a first recharge inlet;

a well head production end, said well head production end being located at said ground level, said well head production end comprising:

a production head, a ground storage tank, said ground storage tank being connected to said production head; and a second recharge inlet;

a well, said well being u-shaped and extending from said well head, substantially horizontally through said aquifer formation, and to said production head, said well comprising:

a pressure portion, said pressure portion being a first portion of said well between said well head and said aquifer formation;

an aquifer portion, said aquifer portion being a second portion of said well within said aquifer formation;

a production portion, said production portion being a third portion of said well between said aquifer formation and said production head;

a lateral casing, said lateral casing being within said well and extending from said well head to said production head and connected to said first recharge inlet and said second recharge inlet, said lateral casing comprising:

a plurality of perforations within said aquifer portion of said well, said perforations being capable of allowing water to flow from said aquifer formation to said lateral casing; and a production string, said production string being within said lateral casing within said well, extending between said well head and said production head, and connected to said well head and said production head, said production string comprising:

a high level sensor, said high level sensor being installed within said production string within said pressure portion and capable of detecting a high water level;

a low level sensor, said low level sensor being installed within said production string within said pressure portion and capable of detecting a low water level;

a plurality of aquifer check valves, said aquifer check valves being installed along said production string within said aquifer portion and being capable of allowing said water from said aquifer formation within said lateral casing to enter said production string while preventing said water from exiting said production string into said lateral casing; and a production check valve, said production check valve being installed within said production string between said aquifer portion and said production portion and capable of allowing said water from within said production string in said aquifer portion to flow into said production string within said production portion while preventing said water from reentering said production string within said aquifer portion; and a control module, said control module being able to control and interact with said air compressor, said air valve, said high level sensor, said low level sensor, said pressure release valve, said first recharge inlet, and said second recharge inlet;

wherein said water naturally flows from said aquifer formation into said lateral casing through said perforations;

wherein said water flows from said lateral casing to said production string through said aquifer check valves;

wherein said air compressor controlled by said control module pressurizes said pneumatic tank;

wherein, when said high level sensor detects said high water level in said production string in said pressure portion, said control module closes said pressure release valve and opens said air valve between said pneumatic tank and said production string, thereby pressurizing said production string in said pressure portion and forcing said water in said production string through said production check valve and into said production string in said production portion;

wherein, when said low level sensor detects said low water level in said production string in said pressure portion, said control module closes said air valve between said pneumatic tank and said well head and opens said pressure release valve, thereby releasing the pressure in said production string and allowing said water to enter said production string within said aquifer portion from said lateral casing through said aquifer check valves and allowing said air compressor to repressurize said pneumatic tank;

wherein said control module repeats opening and closing said air valve and said pressure release valve in response to said high level sensor and said low level sensor until said ground storage tank is filled with said water from said production portion of said production string in order to use said water for distribution; and wherein, when said horizontal water well is not in use, said first recharge inlet and said second recharge inlet controlled by said control module allow treated waste water to enter said lateral casing, thereby storing said treated waste water in said aquifer formation and recharging said aquifer formation.

* * * * *